US006350194B1

(12) United States Patent
Haugen et al.

(10) Patent No.: US 6,350,194 B1
(45) Date of Patent: Feb. 26, 2002

(54) FUME HOOD WITH AIRFLOW CONTROL SYSTEM

(75) Inventors: Robert Haugen, Statesville; Michael Sirkus, Charlotte, both of NC (US)

(73) Assignee: Kewaunee Scientific Corporation, Statesville, NC (US)

( * ) Notice: Subject to any disclaimer, the term of this patent is extended or adjusted under 35 U.S.C. 154(b) by 0 days.

(21) Appl. No.: 09/727,614

(22) Filed: Dec. 1, 2000

(51) Int. Cl.[7] ..... B08B 15/02
(52) U.S. Cl. ..... 454/56; 454/57
(58) Field of Search ..... 454/56, 57, 58, 454/59, 61, 62

(56) References Cited

U.S. PATENT DOCUMENTS

| | | | | |
|---|---|---|---|---|
| 2,819,666 | A | 1/1958 | McNeil et al. | |
| 3,237,548 | A | 3/1966 | Bayern | |
| 3,747,505 | A | 7/1973 | Turko | |
| 3,752,056 | A | 8/1973 | Chamberlin et al. | |
| 4,023,473 | A | 5/1977 | Russell | |
| 4,177,718 | A | 12/1979 | Grow et al. | |
| 4,377,969 | A | 3/1983 | Nelson | |
| 4,534,281 | A | 8/1985 | Parks et al. | |
| 4,856,420 | A | 8/1989 | Poblete et al. | |
| 5,167,572 | A | 12/1992 | Etkin | 454/57 |
| 5,205,783 | A | 4/1993 | Dieckert et al. | 454/238 |
| 5,447,468 | A | 9/1995 | Tener et al. | 454/58 |
| 5,697,838 | A | 12/1997 | Morris | 454/62 |
| 5,797,790 | A | 8/1998 | Rindoks et al. | 454/59 |
| 5,924,920 | A | 7/1999 | DeLuca et al. | 454/62 |

FOREIGN PATENT DOCUMENTS

| | | | | |
|---|---|---|---|---|
| DE | 39 39 063 | * | 5/1991 | 454/56 |

OTHER PUBLICATIONS

Kewaunee Catalog Entitled: *Supreme Air Series—Fume Hoods and instalab Fume Hoods*, SAFH–12/98.

* cited by examiner

*Primary Examiner*—Harold Joyce
(74) *Attorney, Agent, or Firm*—Kennedy Covington Lobdell & Hickman, LLP

(57) ABSTRACT

A laboratory fume hood apparatus and method for containing contaminated air within the confines of the fume hood which includes a generally rectangular housing having a vertically movable door for providing an opening to the interior of the fume hood. A contoured air foil on the bottom of the door, an adjacent sill, openings in the door, a bypass slot formed in the housing and an air directing wall portion within the housing combine to provide a flow of outside air downwardly along the interior surface of the door and then directly toward an exhaust plenum located at the rear wall of the interior cabinet.

13 Claims, 9 Drawing Sheets

FUME HOOD WITH AIRFLOW CONTROL SYSTEM

BACKGROUND OF THE INVENTION

The present invention relates generally to fume hoods used in laboratories and the like to permit technicians to work on materials within the confines of the interior cabinet of the fume hood without exposure to toxic or otherwise dangerous fumes that may be generated by such work, and more particularly to a fume hood of this type in which the fumes or contaminated air is maintained substantially within the confines of the interior cabinet, even when access to the interior is undertaken through a sash opening, by a unique pattern of air flow within the interior of the cabinet.

Fume hoods are constructed with a wide variety of air flow arrangements for directing the flow of outside air in a desired path within the confines of the interior chamber. For example, in Bayern U.S. Pat. No. 3,237,548 a flow path is created within the confines of the fume hood that includes a directed flow of air downwardly along the plane of the sash or door of the fume hood to prevent the escape of contaminated air when the door is open.

In Turko U.S. Pat. No. 3,747,505 a diffuser is provided to direct auxiliary air directly downward and somewhat outwardly when the fume door is open to combine with outside air and form an air flow path that sweeps along the plane of the open door and then along the bottom of the interior cabinet to contain contaminated air within the cabinet. A somewhat similar air flow path is disclosed in Chamberlin U.S. Pat. No. 3,752,056 where a plenum is located above and outside of the door of the fume hood.

In McNeil U.S. Pat. No. 2,819,666 a baffle plate is provided above the door to direct auxiliary air downwardly along the interior surface of the door of the fume hood when it is in its closed position, and this air flow is cut off when the door is opened and air from an upper plenum is used to created a screen of auxiliary air generally in front of the plane of the door when the door is open. Also, a flow of outside air is introduced into the bottom of the interior cabinet of the fume hood and is directed inwardly along the bottom wall of the interior cabinet to remove heavy contaminated air within the cabinet.

A somewhat similar flow pattern is disclosed in Grow U.S. Pat. No. 4,177,718 where a valve member is moved between one position when the fume hood door is closed to direct air downwardly along the interior surface of the door, and another position when the door is open to create a flow of auxiliary air downwardly along the outside plane of the open door.

SUMMARY OF THE INVENTION

In accordance with the present invention, an apparatus and method are provided for containing and properly directing contaminated air within the confines of a fume hood or the like. The apparatus includes a housing forming a generally rectangular interior cabinet that has side walls, a back wall, a top wall, and an open front face, and a door disposed for movement between a closed position closing the open front face and an open position creating an opening through which a technicians hands can extend to work within the interior cabinet. An exhaust plenum is located within the interior cabinet adjacent the back wall thereof, and it is adapted to be connected to an exhaust source for exhausting air from within the interior cabinet. A bypass slot is formed in the housing and disposed to direct outside air downwardly generally along the inside surface of the door, and openings are formed in the door and are disposed to admit outside air into the interior cabinet in a direction generally transverse to the flow of outside along the inside surface of the door to thereby cause the combined flow of the outside air to flow in a direction generally directly toward said exhaust plenum.

In the preferred embodiment of the apparatus of the present invention, the door moves in a vertical direction between the open and closed positions thereof, and a contoured air foil is attached to the bottom edge of the door to direct a flow of outside air inwardly toward the back wall when the door is in its open position.

Additionally, it is preferred that a wall portion be disposed adjacent the upper portion of the interior cabinet and be inclined inwardly and downwardly, and that the bypass slot be formed between the lower end portion of the wall portion and the upper end portion of the door.

It is also preferred that the housing include an air exhaust opening disposed in the top wall thereof generally adjacent the back wall thereof, and in communication with the exhaust plenum.

The method of the present invention includes the steps of creating a first flow path of outside air inwardly into the interior chamber through a by-pass slot formed in the fume hood housing in a direction generally downwardly along the inside surface of the door, creating a second flow path of outside air though the door which is generally inwardly toward the back wall of the interior cabinet, and creating an area of uncontaminated air adjacent the back wall of the interior cabinet. Preferably, the method includes the step additional of creating the aforesaid region of uncontaminated air through air flow through vertical clearance slots formed between the overlapping edges of glass panels included in the door.

In the preferred embodiment of the method of the present invention, such method includes the step of positioning a wall portion within the interior cabinet so that the lower edge thereof is spaced from the door to create the first flow path of air. The method may also include the step of disposing an airfoil along the bottom edge of the door and forming the airfoil with a contour for directing the second flow of outside air inwardly toward the back wall of the interior chamber when the door is opened. Finally the method may include the step of exhausting the outside air from the interior cabinet though an opening in the top wall of the interior cabinet.

DESCRIPTION OF THE PREFERRED EMBODIMENTS

Figure 1:
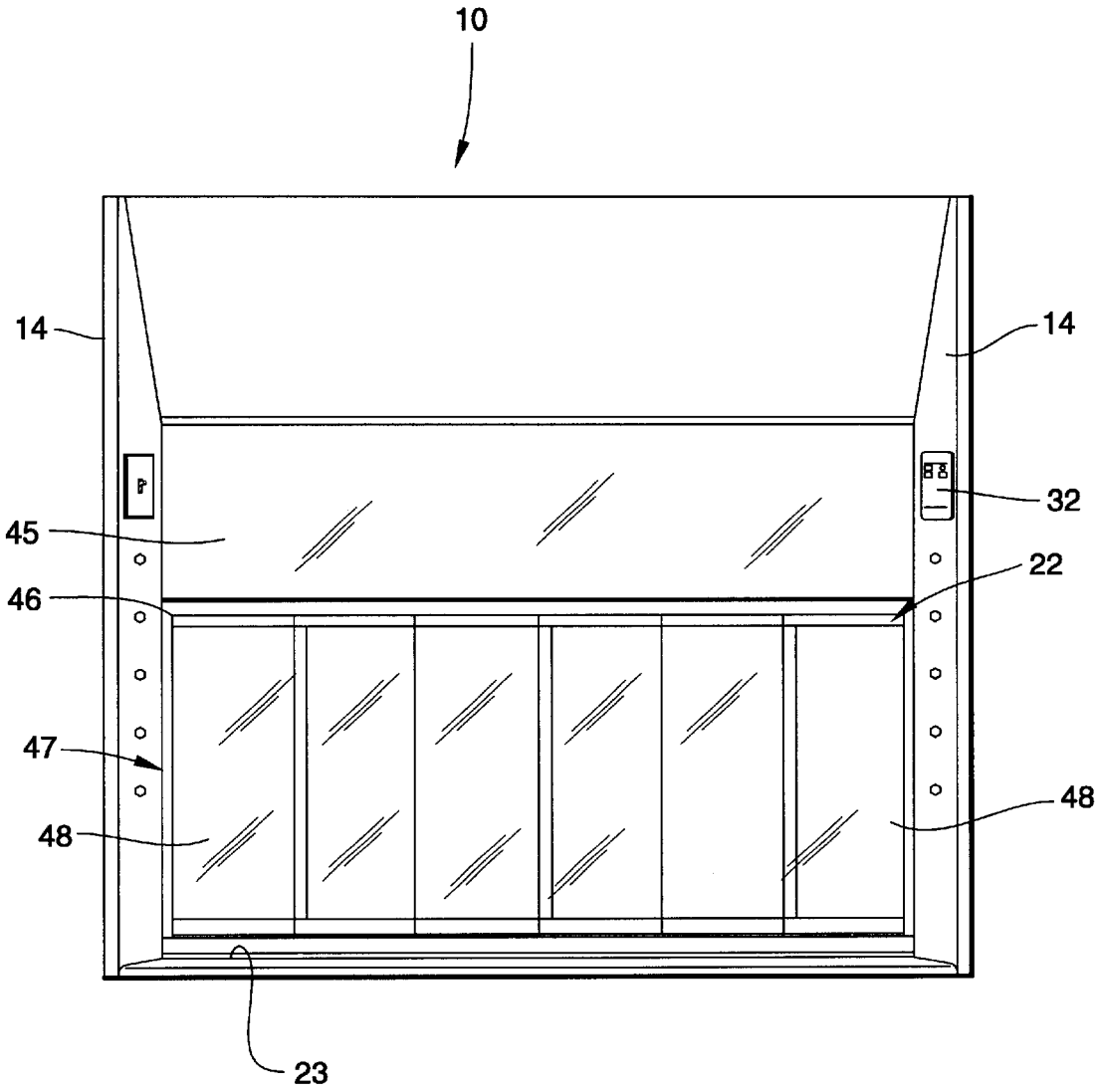
FIG. 1 is a front view of a fume hood according to the present invention.
Figure 2:
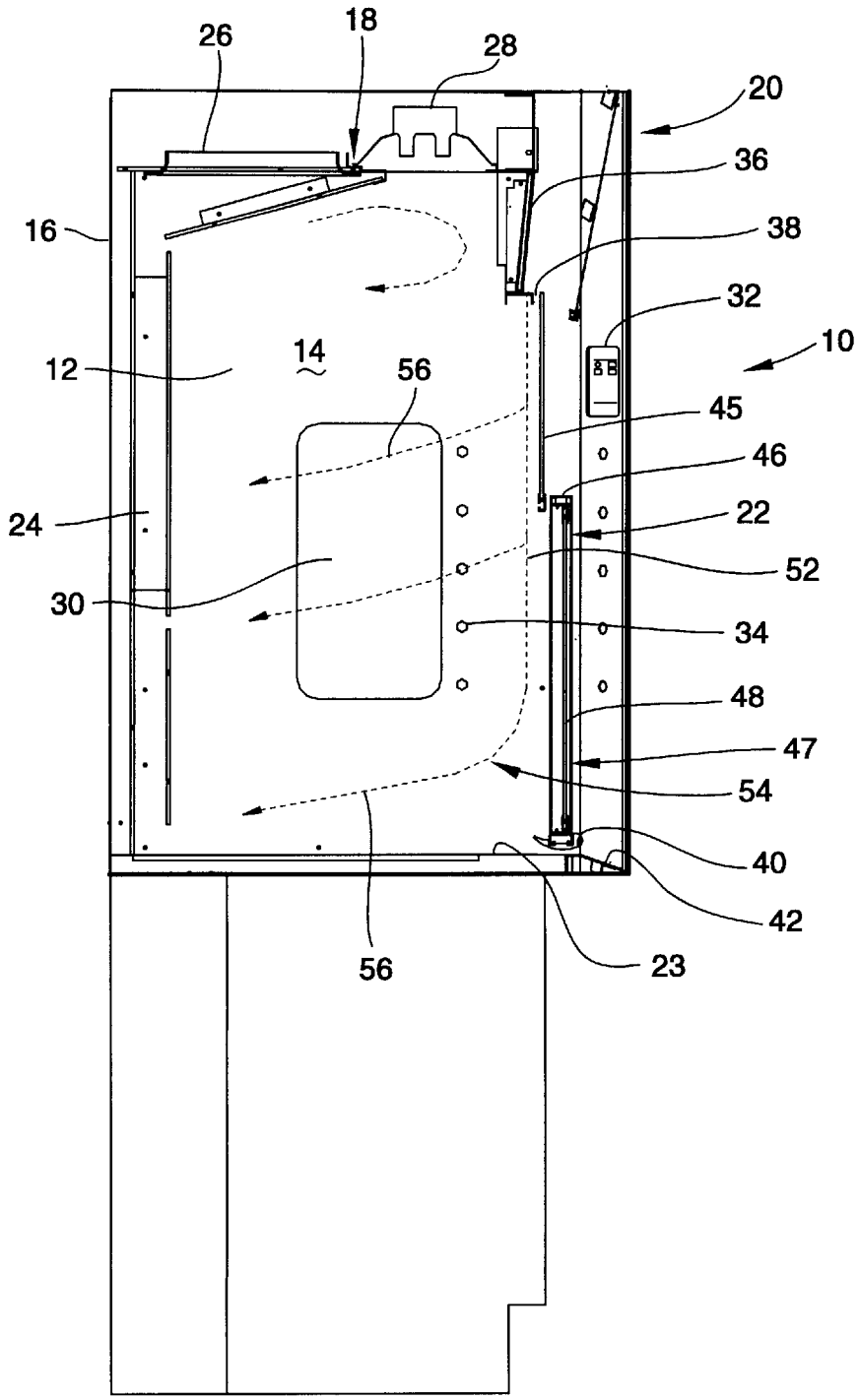
FIG. 2 is a side elevational view of the fume hood illustrated in FIG. 1 taken in a vertical plane at the approximate center of the fume hood.

Looking now in greater detail at the accompanying drawings, FIGS. 1 and 2 illustrate a fume hood 10 that is used in laboratories and the like to permit technicians to work on materials within the confines of the fume hood without exposure to toxic or otherwise dangerous fumes that may be generated by such work.

The fume hood 10 includes a housing 12 that is formed with a generally rectangular interior cabinet 14 which includes side walls 14, a back wall 16, a top wall 18, and a front face 20. The front face 20 has door 22 mounted therein for vertical movement between a raised position at which the front face 20 is opened so that a technicians hands can extend there through to work within the interior cabinet 12, and a lower or closed position at which the door 22 closes the opening in the front face 20. The bottom of the fume hood is generally open allowing the fume hood to sit directly on a laboratory work surface 23 as best seen in FIG. 2, and the door 22 would normally rest on the work surface 23 when the door 22 is in its closed position, but the door 22 is shown in a slightly raised position in FIG. 2 to better illustrate the relationship between the door 22 20 and the work surface 23.

As best seen in FIG. 2, the interior cabinet 12 includes an exhaust plenum 24 that extends vertically along the back wall 16, and the upper end of the exhaust plenum 24 communicates with an exhaust opening 26 in the top wall 18. The exhaust opening 26 is adapted to be connected to any convenient and conventional exhaust source, such as the intake of a blower (not shown), for exhausting air from the interior cabinet 12 in a manner well known in the art. The interior cabinet 12 also includes a conventional fluorescent light fixture 28 for illuminating the inside of the interior cabinet 12, and an access panel 30 through which the side wall electrical and plumbing chase can be accessed through one of the interior side walls. The fume hood 10 may also include a conventional airflow alarm 32, and a plurality of conventional plumbing service outlets 34.

In accordance with one feature of the present invention, the interior cabinet 12 also includes a wall portion 36 that extends downwardly with an inwardly directed incline so that the lower end of the wall portion 36 is spaced from the upper end of the door 22 to thereby provide a bypass slot 38 which is disposed to direct outside air downwardly along the inside surface of the door 22 in a manner to be described in greater detail presently.

The door 22 is illustrated in FIG. 2 almost at its lowermost or closed position, and the bottom edge of the door 22 is provided with a contoured airfoil member 40. The bottom surface of the airfoil 40 is curved slightly upwardly as best seen in FIG. 2 so that when the door 22 is raised to an open position, the contoured bottom surface of the airfoil 40 will direct air toward the back wall 16 and the exhaust plenum 24, and slightly upwardly. In this same regard, the sill 42 of the work surface 23, which is adjacent the airfoil 40 when the door 22 is in its closed position, has a slight upwardly inclined surface portion 44 which also tends to direct inwardly directed air flowing through the opening created by the raised door 22 generally toward the back wall 16 and the exhaust plenum 24.

Figure 3:
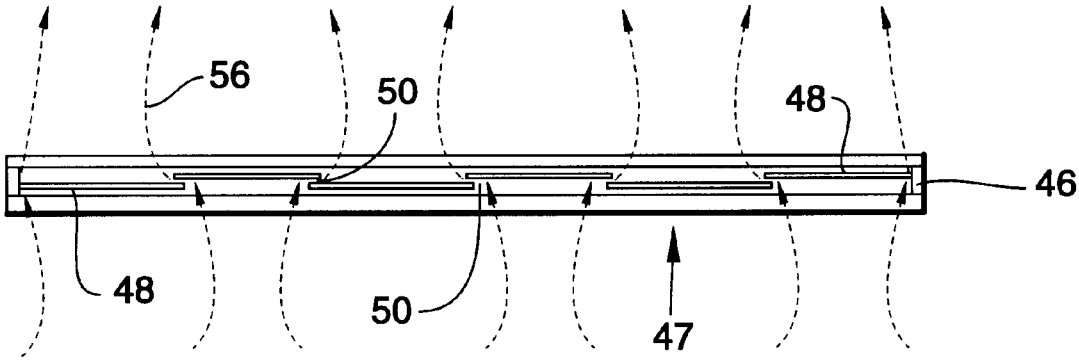
FIG. 3 is a detail view showing slots formed between the overlapping edges of glass panels that form part of the fume hood door.

The door 22, as best seen in FIGS. 2 and 3, includes a first sash 45 that that is formed as a solid rectangular panel, and a second sash 47 that includes a frame 46 in which are mounted a plurality of adjacent glass panels 48 as best seen in FIG. 3. so that they are movable horizontally relative to one another, whereby the front face 20 of the fume hood 10 can be opened by either raising frame 46, which raises the entire second sash 47, or sliding one or more of glass panels 48 sideways to provide an opening in the second sash 47. Additionally, the glass panels 48 are arranged so that the edges of each two adjacent glass panels 48 have a slight overlap, and the overlapping edges are spaced from one another to form relatively narrow vertical slots 50 that extend along the vertical height of the door 22 whereby outside air is permitted to flow through the slots 50. As is well known in the art, the sashes 45 and 47 are connected to a conventional pulley and weight arrangement 49 which assist in raising the second panel 47 upwardly until an extension on the lower end thereof engages the upper sash 45, after which both panels are moved upwardly together. While this arrangement of the sashes 45, 47 and the door 22 are preferred, it will be understood that other conventional, known or equivalent sash arrangements could be used in connection with the present invention so long as the door is formed with openings or slots that will result in the requisite amount of outside air flowing into the interior cabinet 12, as described below.

The above-described structure of the fume hood 10 provides a unique airflow pattern that is particularly effective in creating a barrier flow of clean outside air between the technician located outside the fume hood 10 and the toxic fumes that may be present in the interior cabinet 12 of the present invention when the door 22 is opened.

More specifically, and as best illustrated in FIG. 2, when the exhaust opening 26 is connected to an exhaust source as described above, a negative air pressure is created in the exhaust plenum 24 along the back wall 16 of the fume hood 10. This negative pressure within the interior cabinet 12, even when the door 22 is closed as illustrated in FIG. 2, creates an airflow that is directed by the wall portion 36 downwardly through the bypass slot 38 and generally along the interior surface of the door 22 as indicated by the vertical component 52 of the airflow arrows 54. It is also to be noted that the interior surface of the wall portion 36, with its inwardly directed incline, deflects air circulating with the upper portion of the interior cabinet 12 away from the work area directly behind the door 22.

At the same time, as best illustrated in FIG. 3, outside air is also drawn into the interior cabinet 12 through the vertical slots 50 in the door 22, and this inwardly directed flow of outside air, which is directed toward the back wall 16, influences the vertical airflow component 52 so that the confluence of the two airflows results in a generally rearward flow of the air toward the back wall 16 as indicated by the airflow component 56. Thus, even with the door 22 closed, or substantially closed, there is a pattern of outside airflow which includes a vertically directed component that creates a barrier of outside air along the interior surface of the door 22, and a general flow of air directly toward the exhaust plenum 24 at the back wall 16 of the interior cabinet 12.

Figure 4:
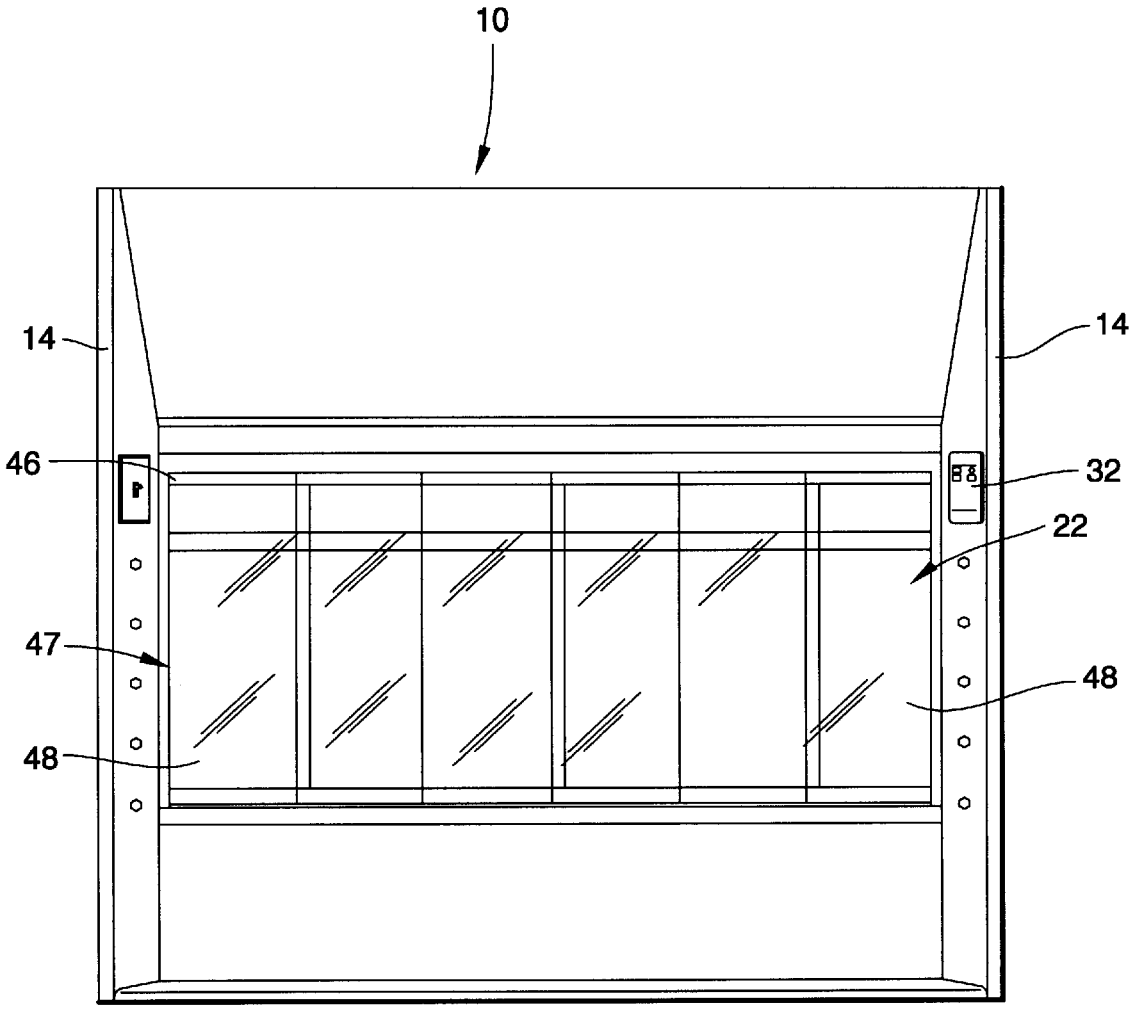
FIG. 4 is a front view of the fume hood of the present invention with the front door raised.
Figure 5:
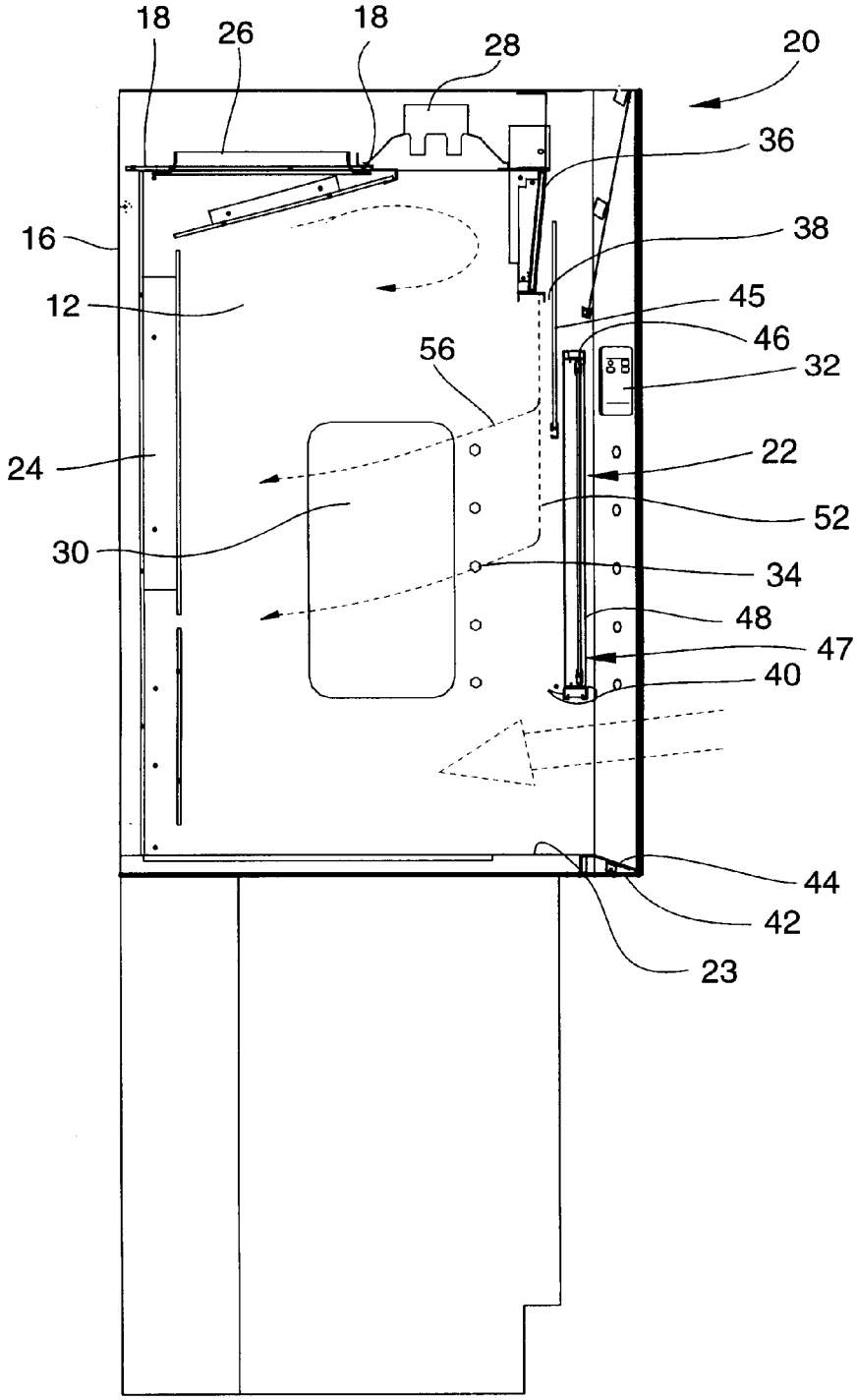
FIG. 5 is a side elevational view of the fume hood illustrated in FIG. 4, and taken along the same plane as FIG. 2.
Figure 6:
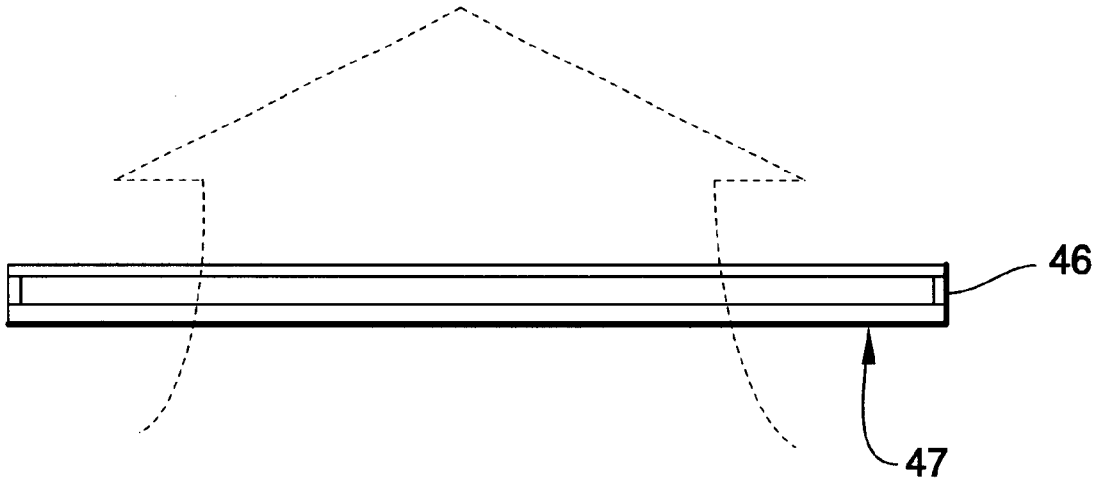
FIG. 6 is a detail view showing the air flow through the open door of FIG. 4.
Figure 7:
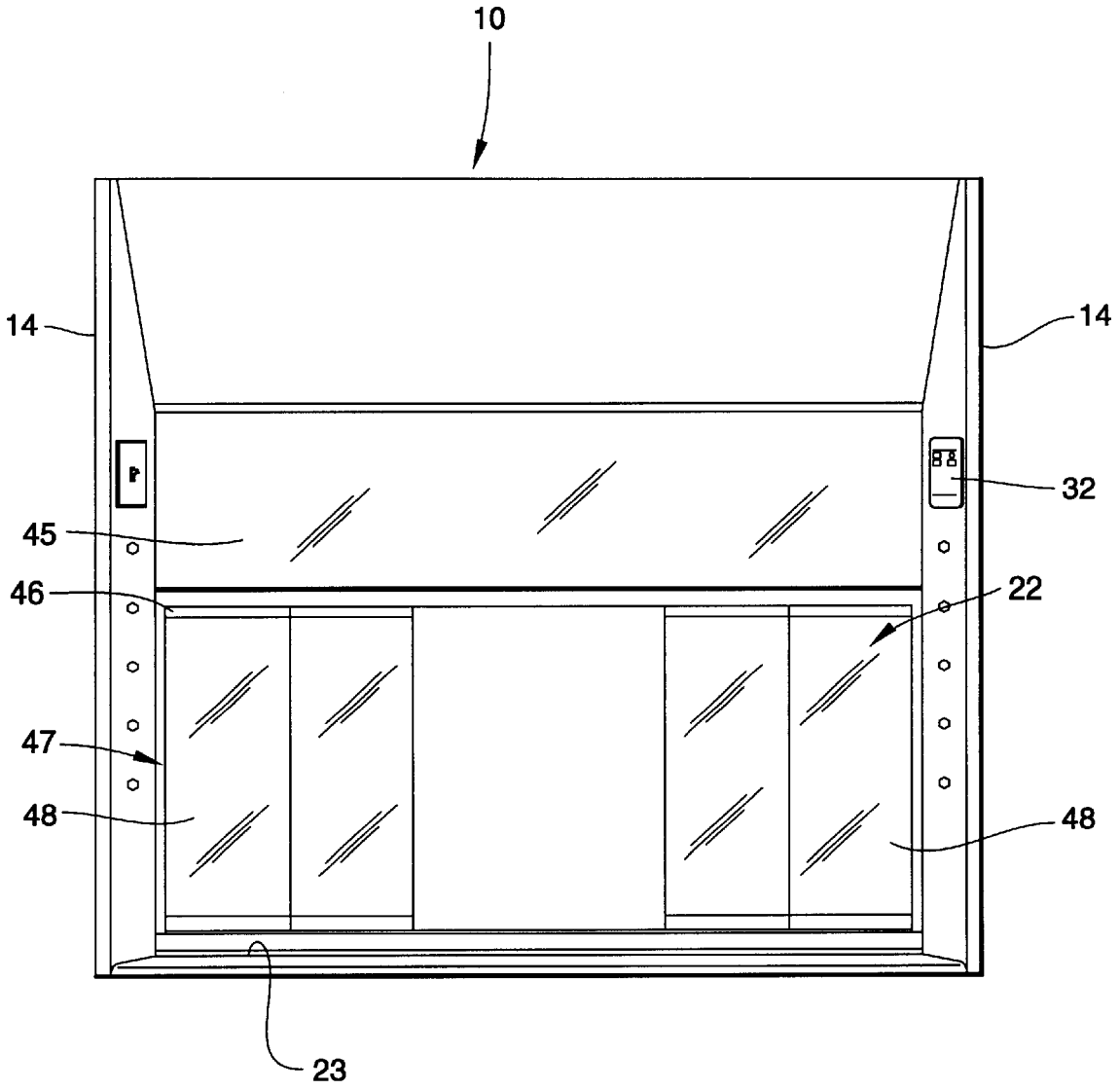
FIG. 7 is a front view of the fume hood of the present invention with some of the glass panels in the door moved to form an opening in the front door.
Figure 8:
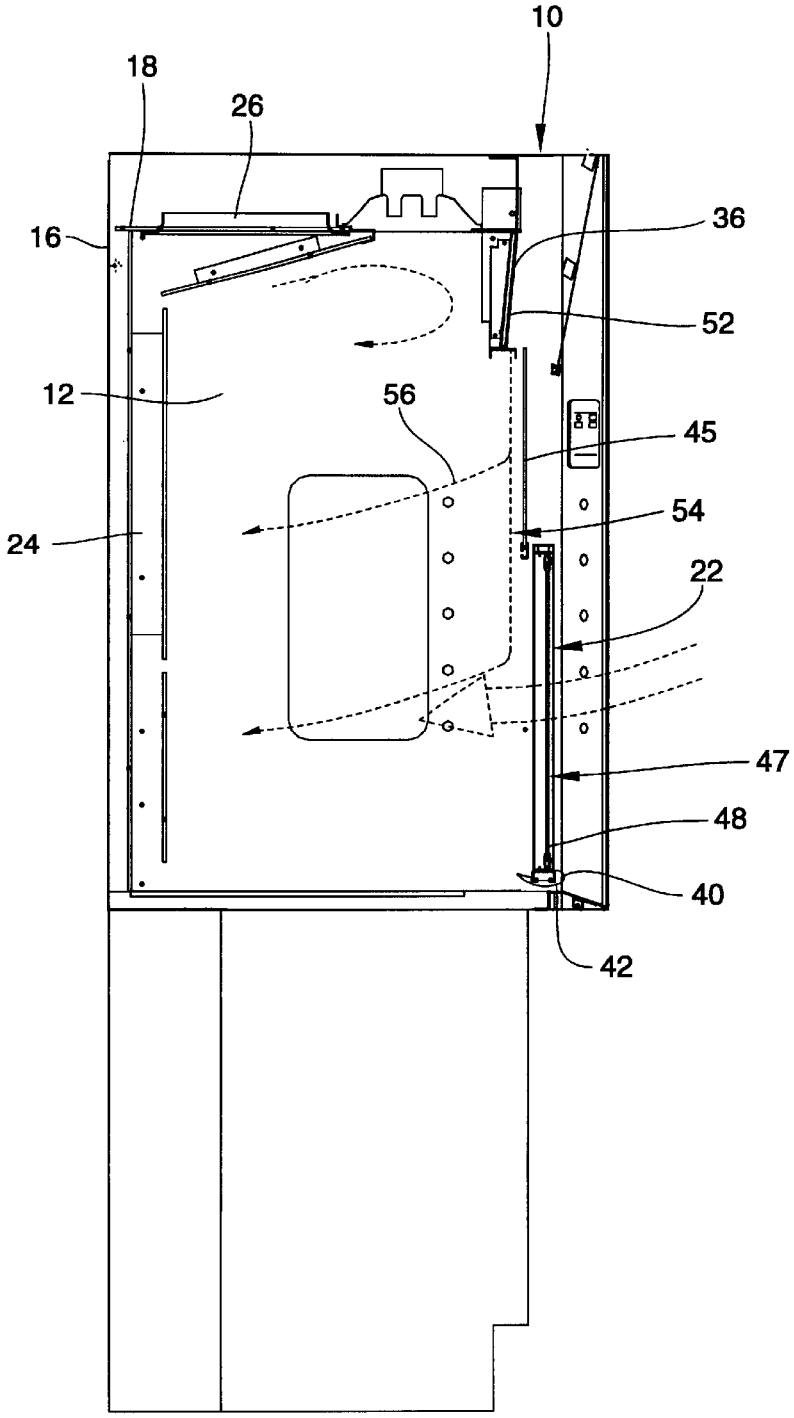
FIG. 8 is a side elevational view, similar to FIG. 5, of the fume hood illustrated in FIG. 7.
Figure 9:
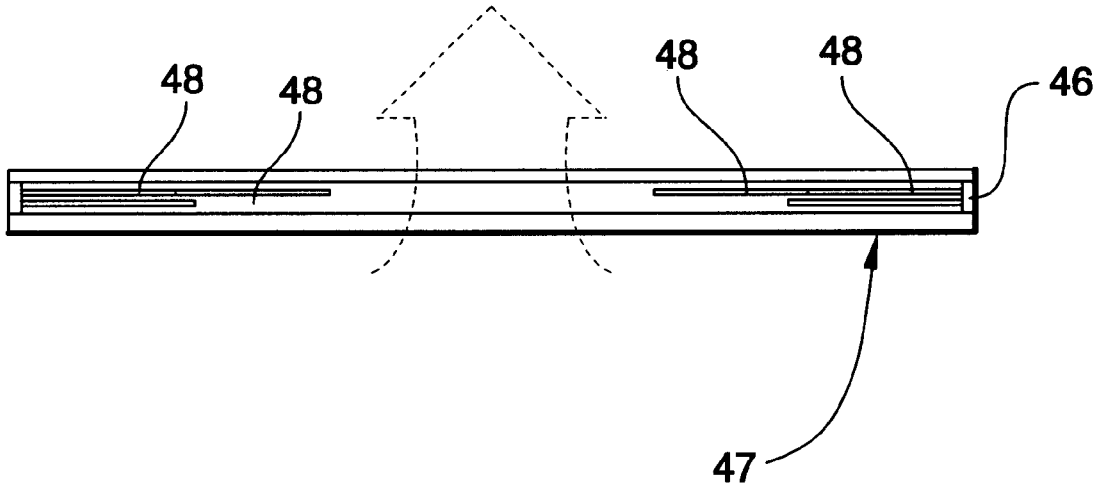
FIG. 9 is a detail view showing the air flow through the open glass panels in FIG. 7.

As discussed above, the door 22 can be opened by raising the second sash 47 in which case outside air flows directly into the fume hood beneath the bottom edge of the second sash 47 as illustrated in FIGS. 4–6, or the door 22 can be opened by sliding one or more of the glass panels 48 sideways, as illustrated in FIGS. 7–9.

Accordingly, when a technician begins raising the door 22 to work within the confines of the interior cabinet 12, outside air will obviously be pulled into the interior cabinet 12 through the opening created by the open door 22, and because of the above-described pre-existing airflow created within the interior cabinet when the door 22 is closed, the outside air flowing through the open door 22 will generally follow and to some extent augment the preexisting flow pattern toward the exhaust plenum 24. By virtue of this arrangement, the airflow within the interior cabinet 12, when the door 22 is open, does not form itself into a vortex that is generally conventional in the art and that can be difficult to control because of the angular momentum inherent in the vortex. Rather, the airflow pattern created by the present invention establishes a barrier of outside air at the door opening to prevent toxic fumes and the like within the interior cabinet 12 from flowing outwardly in a manner that would endanger the technician, and the pattern of the outside airflow moves in a generally straight line direction directly to the exhaust plenum 24 so that the toxic fumes are carried by the flow of outside air directly to the exhaust plenum 24 where they can be exhausted through the exhaust opening 26, all as generally illustrated in FIGS. 5 and 8. Thus, the toxic fumes are removed from the interior cabinet 12 more quickly because of the direct flow to the exhaust plenum 26, and in a more controlled airflow pattern as contrasted with a flow pattern in the form of a vortex.

Those skilled in the art will know that airflow patterns within the confines of a fume hood do not flow in straight, defined lines, and, therefore, it will be appreciated that the description of the airflow patterns created by the present invention is meant to describe the general direction of flow of the great majority of the air. Moreover, it will also be appreciated that the general nature of the airflow can be varied to some extent, if desired, depending on the size of the bypass slot 38 and the vertical slots 50 in the door 22, and by selecting the blower that creates the negative pressure in the exhaust plenum 24. Thus, these variables can be taken in consideration by those skilled in the art in carrying out the present invention in a manner that will best suit the particular application of the fume hood 10.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. A laboratory fume hood for containing contaminated air within the confines thereof comprising:

(a) a housing forming a generally rectangular interior cabinet including side walls, a back wall, a top wall, and an open front face, and a door disposed for movement between a closed position closing said open front face and an open position creating an opening through which a technicians hands can extend to work within said interior cabinet;

(b) a vacuum source located within the interior cabinet adjacent the back wall thereof and adapted to be connected to an exhaust outlet for exhausting air from within the interior cabinet;

(c) a bypass slot formed in said housing and disposed to direct outside air downwardly generally along the inside surface of said door; and (d) openings formed in said door and disposed to admit outside air into said interior cabinet in a direction generally transverse to said flow of outside and along the inside surface of said door to thereby cause the combined flow of said outside air to flow in a direction generally directly toward said exhaust plenum.

2. A laboratory fume hood as defined in claim 1, wherein a wall portion is disposed adjacent the upper portion of said front face of said interior cabinet and is inclined inwardly and downwardly for directing said outside air from said bypass slot to flow along the inside face of said door.

3. A laboratory fume hood as defined in claim 2, wherein said bypass slot is formed between the lower end portion of said wall portion and the upper end portion of said door.

4. A laboratory fume hood as defined in claim 1, wherein said housing includes an air exhaust opening disposed in said top wall thereof generally adjacent said back wall thereof and in communication with said vacuum source.

5. A laboratory fume hood as defined in claim 1, wherein said door includes a plurality of glass panels disposed in side-by-side, partially overlapping relation, and wherein said openings in said door are formed by a spacing between the adjacent overlapping portions of said panels.

6. A laboratory fume hood as defined in claim 5, wherein said overlapping portions of said panels form vertically extending slots between said glass panels.

7. A laboratory fume hood as defined in claim 1, wherein said door is mounted for vertical movement between an open and closed position, and wherein a contoured airfoil member is attached to the bottom edge of said door to direct outside air inwardly toward said back wall when said door is in said open position.

8. A laboratory fume hood for containing contaminated air within the confines thereof comprising:

(a) a housing forming a generally rectangular interior cabinet including side walls, a back wall, a top wall, and an open front face;

(b) a door disposed for vertical movement between a closed position closing said open front face and an open position creating an opening between the bottom of said door and said bottom wall through which a technicians hands can extend to work within said interior cabinet and through which outside air will pass inwardly toward the rear wall of said housing, said door including a plurality of glass panels disposed in side-by-side relation with partially overlapping vertical edges being spaced from one another to form vertically extending slots therebetween through which outside air can flow inwardly into said interior cabinet:

(c) a vacuum source located within the interior cabinet adjacent the back wall thereof and adapted to be connected to a vacuum source for exhausting air from within the interior cabinet;

(d) a bypass slot formed in said housing and disposed to direct outside air downwardly generally along the inside surface of said door; and (e) a wall portion disposed adjacent said front face and disposed generally above said by pass slot to direct the air flow within said interior cabinet in an inward direction, whereby said bypass slot, said vacuum source, said wall portion and said vertical openings in said door combine to create a flow of outside air that passes downwardly along the interior face of said door and then rearwardly toward said exhaust plenum without creating any significant vortex within said interior cabinet.

9. A method of containing contaminated air within the confines of a generally rectangular interior cabinet of a fume hood housing having side walls, a back wall, a top wall and an open front face in which a door is disposed for movement between a closed position closing said open front face and an open position creating an opening through which a technician's hands can extend to work within said interior cabinet, said method including the steps of:

(a) creating a first flow path of outside air inwardly into said interior chamber through a by-pass slot formed in said fume hood housing in a direction generally downwardly along the inside surface of said door;

(b) creating a second flow path of outside air though said door which is generally inwardly and in a direction toward said back wall of said interior cabinet; and (c) creating an area of uncontaminated air adjacent the back wall of said interior cabinet.

10. A method of containing contaminated air as defined in claim 9 and including the step of positioning a wall portion within said interior cabinet so that the lower edge thereof is spaced from said door to create said first flow path of air.

11. A method of containing contaminated air as defined in claim 9 and including the step of disposing a airfoil along the bottom edge of said door and forming said airfoil with a contour for directing said second flow of outside air inwardly toward said back wall of said interior chamber and upwardly within said interior cabinet when said door is in said open position.

12. A method of containing contaminated air as defined in claim 9 and including the step of exhausting said outside air from said interior cabinet though an opening in the top wall of the interior cabinet.

13. A method of containing contaminated air as defined in claim 9 wherein said second flow path of outside air is created by vertical slots extending between overlapping vertical edges of glass panels included in said door.

* * * * *